US006930667B1

(12) United States Patent
Iijima et al.

(10) Patent No.: US 6,930,667 B1
(45) Date of Patent: Aug. 16, 2005

(54) LIQUID CRYSTAL PANEL DRIVING METHOD, LIQUID CRYSTAL DEVICE, AND ELECTRONIC APPARATUS

(75) Inventors: Chiyoaki Iijima, Ina (JP); Minoru Ikeda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 560 days.

(21) Appl. No.: 09/709,722

(22) Filed: Nov. 13, 2000

(30) Foreign Application Priority Data

Nov. 10, 1999 (JP) ..... 11-320142

(51) Int. Cl.[7] ..... G09G 3/36
(52) U.S. Cl. ..... 345/101; 345/87; 345/204; 345/211
(58) Field of Search ..... 345/87, 101, 90, 345/51, 52, 204, 211, 53; 349/72

(56) References Cited

U.S. PATENT DOCUMENTS 4,417,785 A * 11/1983 Nakamura ..... 349/33
4,687,956 A * 8/1987 Itoh et al. ..... 327/108
4,902,107 A * 2/1990 Tsuboyama et al. ..... 349/72
4,923,285 A * 5/1990 Ogino et al. ..... 345/101
5,033,822 A * 7/1991 Ooki et al. ..... 345/101
5,414,441 A * 5/1995 Memarzadeh et al. ..... 345/87
5,903,251 A * 5/1999 Mori et al. ..... 345/101
5,929,833 A * 7/1999 Koshobu et al. ..... 345/101
6,037,920 A * 3/2000 Mizutome et al. ..... 345/87
6,426,735 B1 * 7/2002 Henzen ..... 345/101
6,496,177 B1 * 12/2002 Burton ..... 345/101

* cited by examiner

*Primary Examiner*—Regina Liang
*Assistant Examiner*—Jennifer T. Nguyen
(74) *Attorney, Agent, or Firm*—Oliff & Berridge, PLC

(57) ABSTRACT

A liquid crystal panel driving method is provided for optimizing driving conditions by performing temperature compensation without varying the voltage of a driving signal. In the liquid crystal device, based on a temperature detection result by the temperature sensor, a temperature compensating circuit sets the frame frequency of driving signals output from driving circuits to a liquid crystal panel at a low temperature, thereby performing temperature compensation so that the liquid crystal device is operated under a condition in which the dielectric anisotropy of the liquid crystal is substantially flat. In accordance with the fact that the motion of the liquid crystal molecules becomes active at a high temperature, the temperature compensating circuit sets the frame frequency of the driving signals to be high. Concerning the frame frequency, 50 Hz (or 60 Hz) and an integer multiple of that frequency are avoided.

26 Claims, 15 Drawing Sheets

LIQUID CRYSTAL PANEL DRIVING METHOD, LIQUID CRYSTAL DEVICE, AND ELECTRONIC APPARATUS

BACKGROUND OF THE INVENTION

1. Field of Invention

The present invention relates to liquid crystal panel driving methods, liquid crystal devices, and electronic apparatuses. More particularly, the present invention relates to a temperature compensating technique employed when driving a liquid crystal panel.

2. Description of Related Art

Concerning liquid crystal devices used for various matrix liquid crystal displays, for example, a simple matrix liquid crystal device includes, as shown in FIG. 18, a liquid crystal panel 10, driving circuits (a signal electrode driving circuit 20 and a scanning electrode driving circuit 30) for driving the liquid crystal panel 10, a liquid crystal power supply circuit 40 for supplying various DC power to the driving circuits 20 and 30, and a liquid crystal drive control circuit 50 for controlling the driving circuits 20 and 30 and causing the driving circuits 20 and 30 to output predetermined driving signals to the liquid crystal panel 10. A reference clock signal CK (synchronizing signal) at a predetermined frequency is output from an oscillation circuit 60 to the liquid crystal drive control circuit 50. The liquid crystal drive control circuit 50 causes the signal electrode driving circuit 20 and the scanning electrode driving circuit 30 to output driving signals having frequencies corresponding to the reference clock signal CK to the liquid crystal panel 10.

Concerning the liquid crystal panel 10, as schematically shown in FIGS. 2 and 3, a top polarizer 11, a retardation film 12, a top substrate 13 having striped Y electrodes Y1, Y2, Y3, . . . formed on an inner surface thereof, a liquid crystal layer 15, a sealant 16 for sealing the liquid crystal layer 15, a bottom substrate 18 having striped X electrodes X1, X2, X3, . . . formed on an inner surface thereof, a bottom polarizer 14, and a light diffusing plate 19 are disposed in the order mentioned. The X electrodes X1, X2, X3, . . . and the Y electrodes Y1, Y2, Y3, . . . extend in the mutually intersecting directions of the X electrodes and the Y electrodes. As shown in FIG. 4, pixels $P_{11}$, $P_{12}$, $P_{13}$, . . . are formed in a matrix arrangement by portions of these transparent electrodes which intersect each other. These pixels $P_{11}$, $P_{12}$, $P_{13}$, . . . are provided with the liquid crystal panel 10 formed of the Y electrodes Y1, Y2, Y3, . . . on the top substrate 13, the liquid crystal layer 15, and the X electrodes X1, X2, X3, . . . on the bottom substrate 18.

Concerning this liquid crystal panel 10, the orientation states of liquid crystals in the pixels (liquid crystal cells) are controlled by driving signals applied to the X electrodes X1, X2, X3, . . . and the Y electrodes Y1, Y2, Y3, . . . . As a result, the optical characteristics of the pixels (liquid crystal cells) $P_{11}$, $P_{12}$, $P_{13}$, . . . vary. Various images can be displayed by utilizing differences in the optical characteristics of the pixels $P_{11}$, $P_{12}$, $P_{13}$, . . . .

Referring to FIGS. 5(A) and (B), examples of driving signals used for driving the liquid crystal panel 10 are described. FIGS. 5(A) and (B) are a waveform chart of a driving signal (scanning signal) applied to the Y electrodes Y1, Y2, Y3, . . . , and a waveform chart of a driving signal (image signal) applied to the X electrodes X1, X2, X3, . . . , respectively. In FIGS. 5(A) and (B), the waveforms corresponding to two frame periods are shown.

In FIG. 5(A), in the first frame period H, voltage V5 of the scanning signal is at a non-selecting voltage level, and voltage V1 is at a selecting voltage level. In this selection period, when voltage V6 is applied to the X electrodes X1, X2, X3, . . . , an ON voltage is applied to the liquid crystal layer 15. When voltage V4 is applied to the X electrodes X1, X2, X3, . . . , an OFF voltage is applied to the liquid crystal layer 15. In accordance with such variations in the voltage, the liquid crystal layer 15 controls the polarization of incident light, and an image is thus displayed on the liquid crystal panel 10. These potentials V1, V2, V3, . . . are generated by the liquid crystal power supply circuit 40.

According to the liquid crystal device with the above structure, for example, when one frame period H is 16.6 μsec and 32 X electrodes X1, X2, X3, . . . are driven, one selection period is 518.8 μsec per pixel. Under these conditions, when an image signal repetitively becomes on and off, the maximum frequency of the signal applied to the liquid crystal layer 15 is 1.92 kHz.

SUMMARY OF THE INVENTION

Concerning the liquid crystal device, when the ambient temperature decreases, the light passing through the liquid crystal panel 10 varies, which may degrade the contrast. This problem may result from the fact that frequency characteristics of the dielectric anisotropy $\Delta\epsilon$ of the liquid crystal strongly vary with temperature. This occurs due to a sudden variation in a threshold voltage Vth of each of the liquid crystals forming the pixels $P_{11}$, $P_{12}$, $P_{13}$.

Concerning the liquid crystal device, when the ambient temperature increases, the speed of motion of the liquid crystal molecules may also increase. At a frequency of a conventional driving signal, the liquid crystal molecules respond until the subsequent writing is performed. Hence, there is a problem in that the image may be degraded.

Accordingly, an object of the present invention is to at least provide a liquid crystal panel driving method in which driving conditions are optimized by compensating a driving signal for temperature, a liquid crystal device, and an electronic apparatus using the liquid crystal device.

In various exemplary embodiments of the present invention, the threshold voltage Vth for driving the liquid crystal is in direct proportion to a value obtained by the following expression (1):

$$(k/\Delta\epsilon)1/2 \quad (1)$$

The threshold voltage Vth is a voltage at which optical characteristics start to change when a voltage applied to the liquid crystal layer is equal to or greater than that voltage. In expression (1), $\Delta\epsilon$ is a value related to the dielectric anisotropy and k is a value related to the coefficient of elasticity. Concerning this expression, a detailed description is given by expression (2.15) on p. 36 of "Fundamentals and Applications of Liquid Crystals", by Shoichi Matsumoto and Ichiyoshi Tsunoda, Institute for Industrial Research.

From expression (1), the threshold voltage Vth is dependent on the dielectric anisotropy $\Delta\epsilon$. In view of the fact that the frequency characteristics of the dielectric anisotropy $\Delta\epsilon$ have temperature dependence, the Inventors proposed to utilize these frequency characteristics to perform temperature compensation. This is schematically described with reference to FIG. 8.

FIG. 8 is a graph showing the frequency characteristics of the dielectric anisotropy $\Delta\epsilon$ of the liquid crystal at each temperature. Solid lines L1 to L6 represent frequency characteristics at −20° C., −10° C., 0° C., +25° C., +50° C., and +70° C., respectively.

In FIG. 8, the frequency characteristics at temperatures ranging from −20° C. to +70° C. are shown. At a relatively high temperature (for example, +70° C.), the frequency characteristics shown are such that the dielectric anisotropy $\Delta\epsilon$ is substantially flat up to approximately 100 kHz. In contrast, when the temperature is −20° C., the dielectric anisotropy $\Delta\epsilon$ suddenly starts to decrease at about 1 kHz. Specifically, when the temperature decreases, a frequency band of the driving signal overlaps a transition region (region in which $\Delta\epsilon$ suddenly changes) of the dielectric anisotropy $\Delta\epsilon$, and $\Delta\epsilon$ of the liquid crystal suddenly decreases. As a result, the threshold voltage Vth suddenly decreases.

Accordingly, the Inventors propose to change the frequency of the driving signal depending on the temperature, thereby maintaining the threshold voltage Vth of the liquid crystal panel 10 substantially constant. For example, concerning the driving signals shown in FIGS. 5(A) and (B), when one frame period is 16.6 msec and 32 X electrodes are driven, the frame frequency is 60 Hz and one selection period is 518.8 $\mu$sec. Under these conditions, when an image signal repetitively becomes on and off, the frequency of the signal applied to the liquid crystal layer 15 becomes a maximum of 1.92 kHz. In contrast, when the temperature decreases, the frequency of the driving signal is reduced to, for example, 1/2. Hence, the frequency becomes 0.96 kHz. Even when the temperature is −20° C., the dielectric anisotropy $\Delta\epsilon$ is substantially flat. At this time, the frame frequency is 30 Hz. When the frequency of the driving signal is changed depending on the temperature, it is possible to prevent the dielectric anisotropy $\Delta\epsilon$ from varying with frequency. Hence, it is possible to suppress large variations in the threshold voltage Vth.

Specifically, according to various exemplary embodiments of the present invention, there is provided a liquid crystal panel driving method for a liquid crystal panel having a liquid crystal between a pair of electrodes in which the optical characteristics of the liquid crystal are changed by applying a driving signal between the pair of electrodes. The temperature of the liquid crystal panel or the temperature of an environment in which the liquid crystal panel is disposed is sensed. A low frequency signal, which is lower than that used at the normal temperature, is used as the driving signal at a low temperature based on the temperature detection results.

According to the present invention, the normal temperature ranges from +15° C. to +25° C.

Therefore, according to the present invention, when the ambient temperature decreases, the liquid crystal panel is driven by the driving frequency at a frequency in which the dielectric anisotropy $\Delta\epsilon$ does not vary. Hence, the contrast is not degraded.

According to various exemplary embodiments of the present invention, it is preferable that a high frequency signal higher than that used at the normal temperature be used as the driving signal at a high temperature based on the temperature detection results. When the ambient temperature increases, it is not necessary to take variations in the dielectric anisotropy $\Delta\epsilon$ into consideration. Instead, it is necessary to drive the liquid crystal panel with a cycle in accordance with the motion of the liquid crystal molecules. According to various exemplary embodiments of the present invention, when the temperature increases, the frequency of the driving signal is set to be high. The subsequent writing is performed before the liquid crystal molecules respond. This prevents degradation of the image quality. Even when the temperature increases, it is possible to display a high-quality image.

According to various exemplary embodiments of the present invention, it is preferable that the frequency of the driving signal vary discontinuously with respect to the temperature. For example, a frame frequency obtained when performing time-division driving of a plurality of pixels arranged in a matrix form on the liquid crystal panel is varied, based on the temperature detection results, so that at least a frequency corresponding to an integer multiple of 50 Hz is avoided. In addition, the frame frequency obtained when performing time-division driving of a plurality of pixels arranged in a matrix form on the liquid crystal panel is varied, based on the temperature detection results, so that at least a frequency corresponding to an integer multiple of 60 Hz is avoided. With this arrangement, the frame frequency does not overlap the frequency of the commercial power supply. It is thus possible to prevent flicker from occurring in an image displayed under fluorescent light.

For example, it is preferable that the frame frequency be set to not greater than 40 Hz when the temperature is −20° C. Preferably, the frame frequency is set in the range of 70 Hz to 90 Hz when the temperature is +25° C. Preferably, the frame frequency is set to not less than 130 Hz when the temperature is +70° C.

According to various exemplary embodiments of the present invention, a driving frequency of each pixel of the liquid crystal panel is set so that, when the temperature is −20° C., each pixel is driven at a frequency not greater than 1.28 kHZ. When the temperature is +25° C., the driving frequency is set so that each pixel is driven at a frequency not greater than 2.56 kHz. When the temperature is, for example, +70° C., the driving frequency of each pixel of the liquid crystal panel is set so that each pixel is driven at a frequency not greater than 4.16 kHz.

According to various exemplary embodiments of the present invention, there is provided a liquid crystal device having a liquid crystal panel having a liquid crystal between a pair of substrates and a driving circuit for applying a driving signal between the pair of substrates and varying the optical characteristics of the liquid crystal. The liquid crystal device includes a temperature sensor for sensing the temperature, and temperature compensating device for using a low frequency signal lower than that used at the normal temperature as the driving signal at a low temperature based on the temperature detection results obtained by the temperature sensor.

According to various exemplary embodiments of the present invention, it is preferable that, at a high temperature, the temperature compensating device use a high frequency signal higher than that used at the normal temperature as the driving signal which is supplied from the driving circuit to the liquid crystal panel.

According to various exemplary embodiments of the present invention, it is preferable that the temperature compensating device discontinuously varies the frequency of the driving signal with respect to the temperature. For example, the temperature compensating device varies a frame frequency obtained when performing time-division driving of a plurality of pixels arranged in a matrix form on the liquid crystal panel, based on the temperature detection results, so that at least a frequency corresponding to an integer multiple of 50 Hz is avoided. In addition, the temperature compensating device varies a frame frequency obtained when performing time-division driving of a plurality of pixels arranged in a matrix form on the liquid crystal panel, based on the temperature detection results, so that at least a frequency corresponding to an integer multiple of 60 Hz is avoided.

According to various exemplary embodiments of the present invention, when the temperature compensating device varies the frame frequency while avoiding a specific frequency, it is preferable that the frame frequency be varied in a hysteretic manner. With this arrangement, hunting does not occur even when the frame frequency discontinuously varies at the specific frequency.

According to various exemplary embodiments of the present invention, the temperature compensating device avoids a specific frequency and varies the frame frequency in accordance with the temperature detection results by varying the frame frequency in a stepwise manner. The temperature compensating device may continuously vary the frame frequency in accordance with the temperature detection results except when the frame frequency is varied while avoiding a specific frequency.

According to various exemplary embodiments of the present invention, the temperature compensating device sets the driving frequency of each pixel of the liquid crystal panel to not greater than 1.28 kHz when the temperature is −20° C. and to not greater than 2.56 kHz when the temperature is +25° C. When the temperature is, for example, +70° C., the temperature compensating device sets the driving frequency of each pixel of the liquid crystal panel to not greater than 4.16 kHz.

According to various exemplary embodiments of the present invention, it is preferable that the temperature compensating device sets the frame frequency to not greater than 40 Hz when the temperature is −20° C., sets the frame frequency in the range of 70 Hz to 90 Hz when the temperature is +25° C., and sets the frame frequency to not less than 130 Hz when the temperature is +70° C.

According to various exemplary embodiments of the present invention, the temperature compensating device is a synchronizing signal frequency varying device for varying the frequency of the driving signal by varying the frequency of a synchronizing signal applied to a liquid crystal drive control circuit for controlling the driving circuit based on the temperature detection results.

According to various exemplary embodiments of the present invention, the temperature sensor is a thermistor formed together with the driving circuit in a semiconductor device. Such a thermistor can be formed on a silicon substrate in a manner similar to forming other circuits.

Such a liquid crystal device is suitable for a display device of an electronic apparatus, such as a cellular phone operated outdoors at +20° C. or less.

DETAILED DESCRIPTION OF PREFERRED EMBODIMENTS

The present invention will be understood from the following description of the exemplary embodiments with reference to the drawings.

Exemplary Embodiment 1

(Overall structure)

Figure 1:
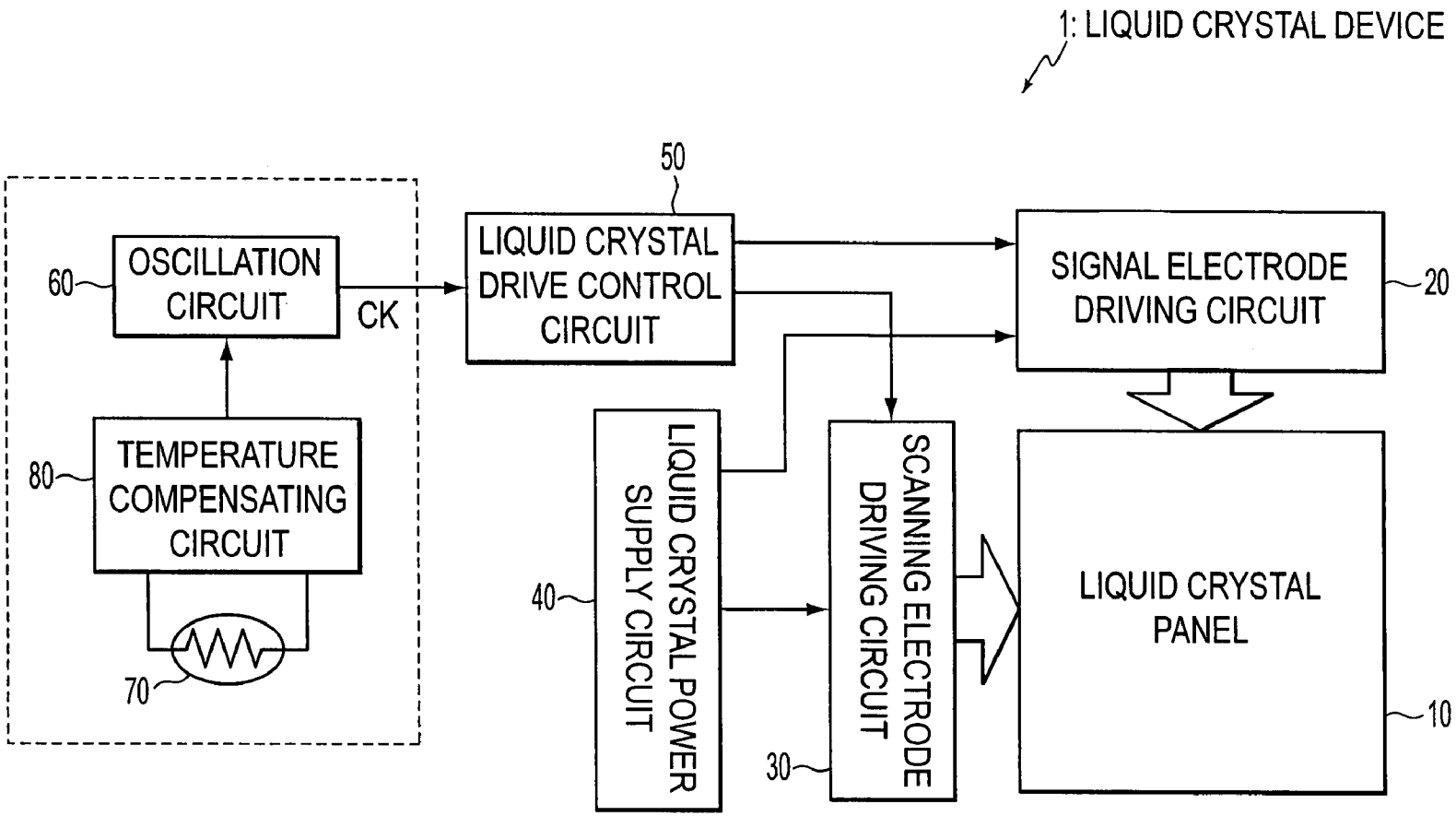
FIG. 1 is a block diagram of the schematic structure of a liquid crystal device according to a first exemplary embodiment of the present invention.
Figure 2:
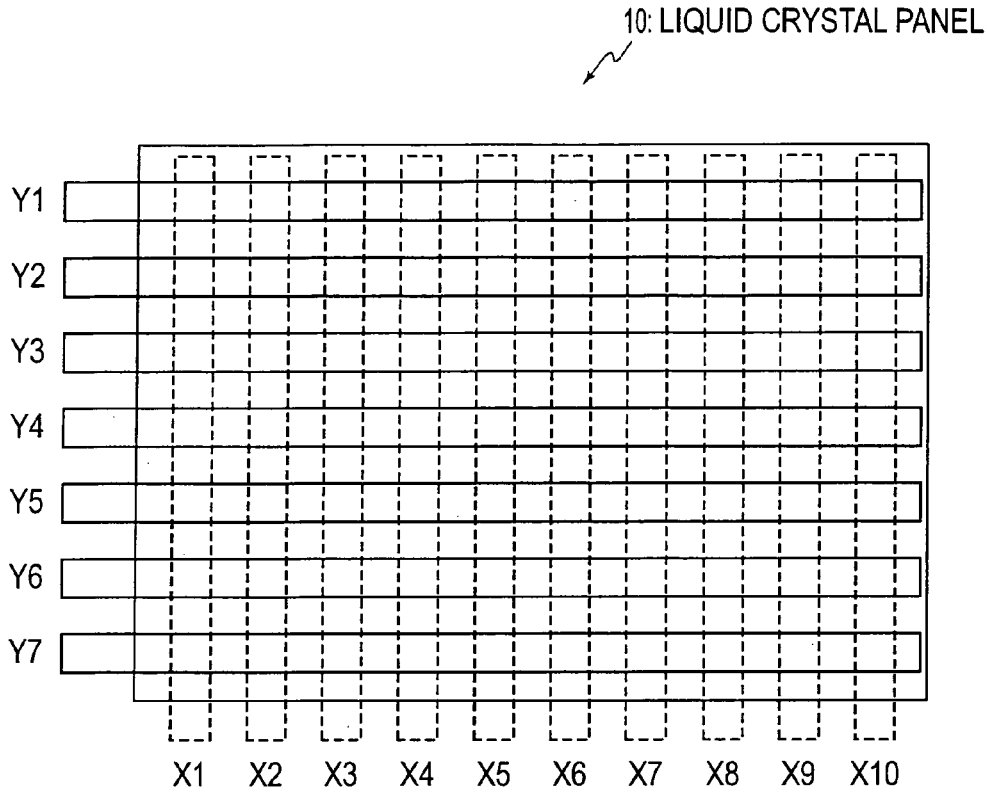
FIG. 2 is a plan view of a liquid crystal panel used in the liquid crystal device shown in FIG. 1.
Figure 3:
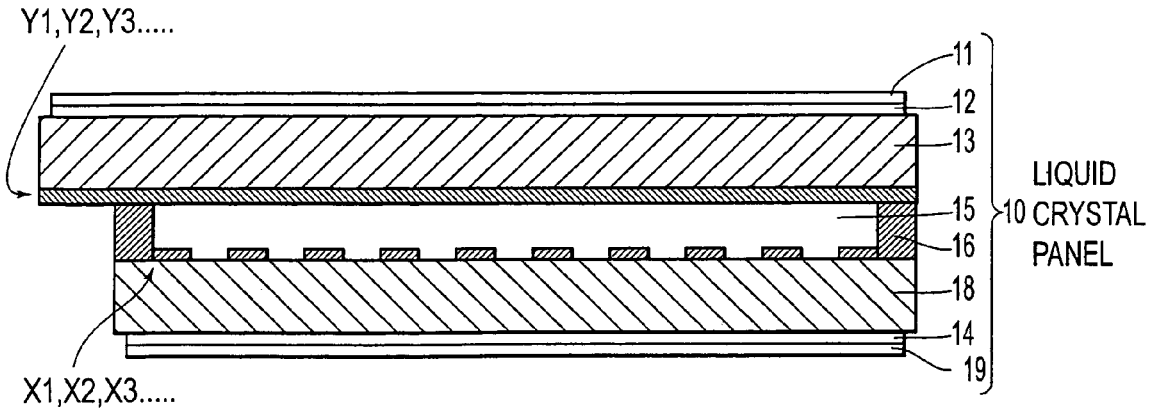
FIG. 3 is a sectional view of the liquid crystal panel shown in FIG. 2.
Figure 4:
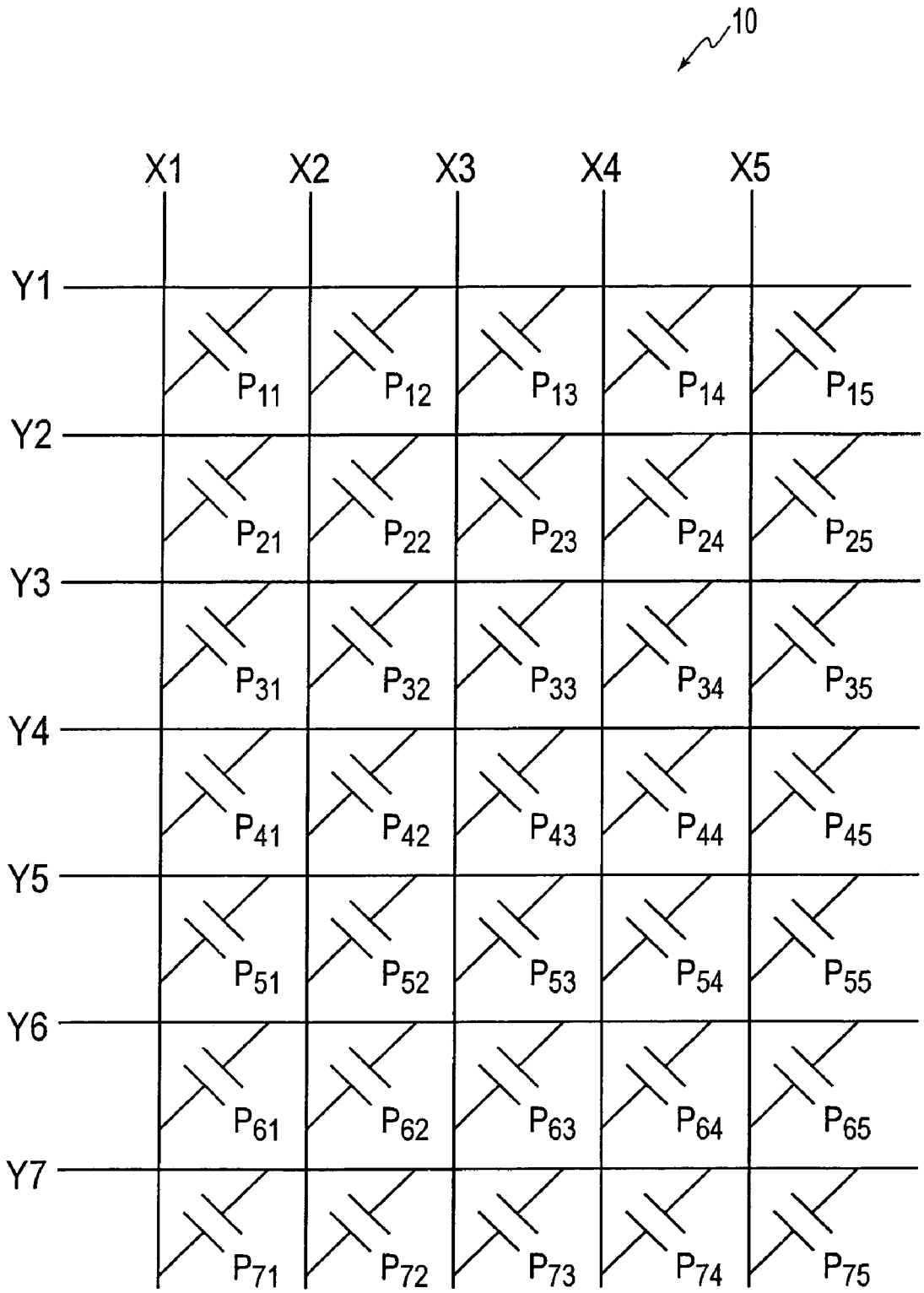
FIG. 4 is an equivalent circuit diagram of the liquid crystal panel shown in FIG. 2.
Figure 5:
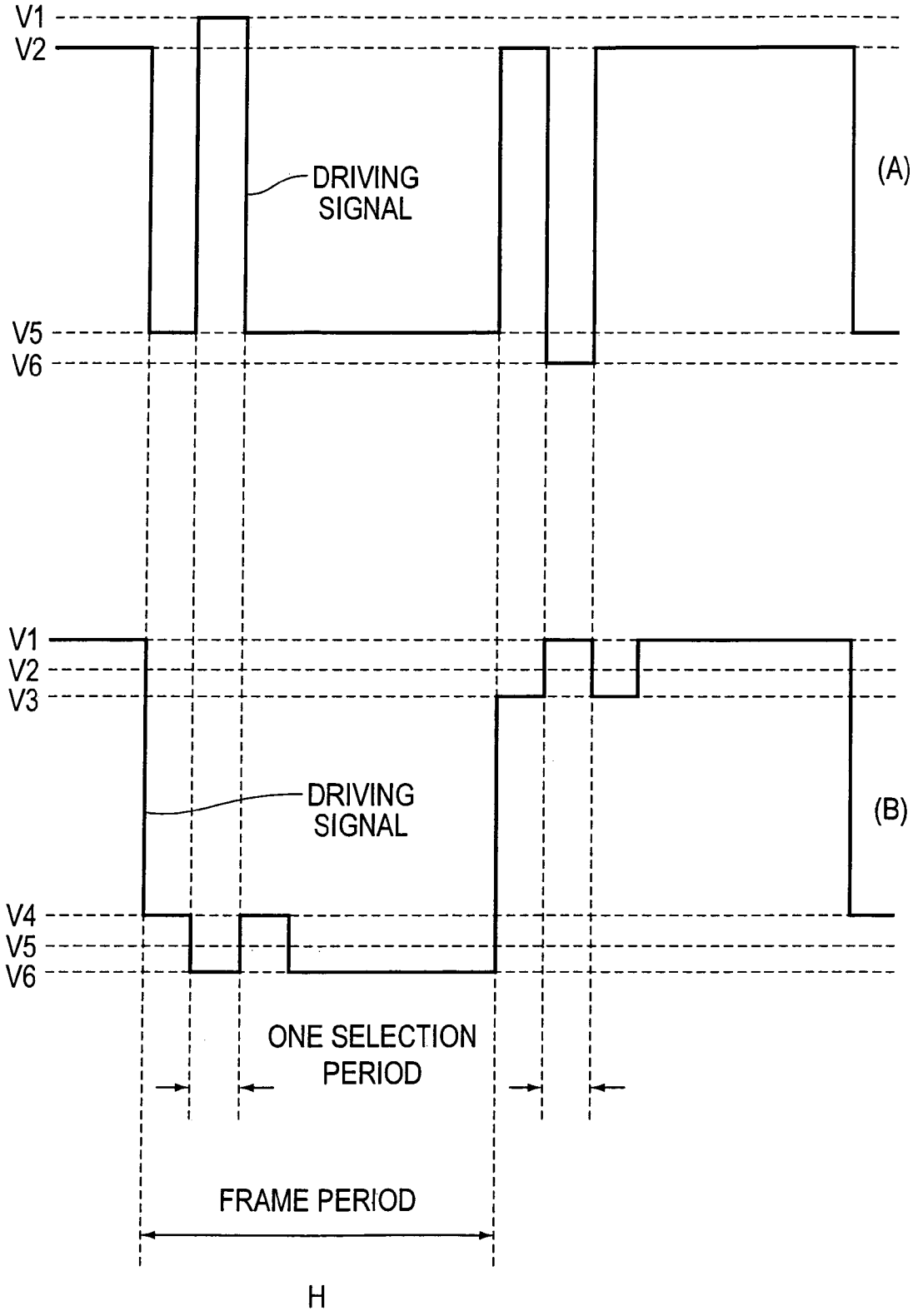
FIGS. 5(A) and (B) are waveform charts of two driving signals (an image signal and a scanning signal) for driving the liquid crystal panel shown in FIG. 4.

FIG. 1 is a block diagram of the schematic structure of a liquid crystal device according to a first exemplary embodiment of the present invention. FIGS. 2 and 3 are a plan view and a sectional view, respectively, of a liquid crystal panel 10 used in the liquid crystal device. FIG. 4 is an equivalent circuit diagram of the liquid crystal panel 10. FIG. 5 includes waveform charts of driving signals used for the liquid crystal device.

As shown in FIG. 1, a simple matrix liquid crystal device 1 of this exemplary embodiment includes the liquid crystal panel 10, driving circuits (a signal electrode driving circuit 20 and a scanning electrode driving circuit 30) for driving the liquid crystal panel 10, a liquid crystal power supply circuit 40 for supplying various DC power (potentials V1, V2, V3, . . . shown in FIG. 5) to the driving circuits 20 and 30, and a liquid crystal drive control circuit 50 for controlling the driving circuits 20 and 30 and causing the driving circuits 20 and 30 to output predetermined driving signals to the liquid crystal panel 10. A reference clock signal CK (synchronizing signal) with a predetermined frequency is output from an oscillation circuit 60 to the liquid crystal drive control circuit 50. The liquid crystal drive control circuit 50 causes the signal electrode driving circuit 20 and the scanning electrode driving circuit 30 to output the driving signals having frequencies in accordance with the reference clock signal CK.

Concerning the liquid crystal device 1 of the embodiment, a temperature sensor 70 is provided for directly sensing the temperature of the liquid crystal panel 10 or sensing the temperature of the environment in which the liquid crystal panel 10 is disposed. Based on the temperature detection results obtained by the temperature sensor 70, a temperature compensating circuit (temperature compensating device) 80 sets the driving signals supplied from the driving circuits 20 and 30 to the liquid crystal panel 10 to be low frequency signals at a low temperature and sets the driving signals supplied from the driving circuits 20 and 30 to the liquid crystal panel 10 to be high frequency signals at a high temperature. This is described in detail in the following description.

(Structure of the liquid crystal panel)

Concerning the liquid crystal panel 10 used in the liquid crystal device 1, as shown in FIGS. 2 and 3, striped Y electrodes Y1, Y2, Y3, . . . formed of transparent conductive films such as ITO are formed on an inner surface of a top substrate 13. Striped X electrodes X1, X2, X3, . . . formed of transparent conductive films such as ITO are formed on an inner surface of a bottom substrate 18. A liquid crystal layer 15 in, for example, the STN mode is held between the top substrate 13 and the bottom substrate 18. At one side of one of a pair of the substrates, a top polarizer 11 and a retardation film 12 are disposed. At the other side, a bottom polarizer 14 and a light diffusing plate 19 are disposed. The pair of substrates 13 and 18 are bonded by a sealant 16. The liquid crystal layer 15 is encapsulated in the gap. Both the top substrate 13 and the bottom substrate 18 are formed of transparent substrates, such as glass. The X electrodes X1, X2, X3, . . . and the Y electrodes Y1, Y2, Y3, . . . extend in mutually intersecting directions. One group of the X electrodes and the Y electrodes includes scanning electrodes to which a scanning voltage is applied, and the other group includes signal electrodes to which an image signal is applied.

When the liquid crystal panel 10 is a reflecting type, a reflector may be disposed at the bottom. The X electrodes on the inner surface of the bottom substrate 18 may be reflecting electrodes, and the bottom polarizer 14 and the light diffusing plate 19 may be omitted. When the liquid crystal panel 10 is used as a transmitting type, a light lamp is disposed under the diffusing plate 19.

Therefore, as shown in FIG. 4, pixels $P_{11}$, $P_{12}$, $P_{13}$, . . . are formed in a matrix arrangement by intersecting portions of the transparent electrodes X1, X2, X3, . . . , and Y1, Y2, Y3, . . . on the liquid crystal panel 10. Concerning these pixels $P_{11}$, $P_{12}$, $P_{13}$, . . . , the liquid crystal panel 10 is formed of the Y electrodes Y1, Y2, Y3, . . . on the top substrate 13, the liquid crystal layer 15, and the X electrodes X1, X2, X3, . . . on the bottom substrate 18.

On the liquid crystal panel 10, concerning the pixels (liquid crystal cells) $P_{11}$, $P_{12}$, $P_{13}$, . . . , the liquid crystal molecular orientation is controlled by the driving signals applied to the X electrodes X1, X2, X3, . . . and the Y electrodes Y1, Y2, Y3, . . . . As a result, the optical characteristics of the pixels $P_{11}$, $P_{12}$, $P_{13}$, . . . are changed. By utilizing differences in the optical characteristics of the pixels $P_{11}$, $P_{12}$, $P_{13}$, . . . , various images can be displayed.

Referring to FIGS. 5(A) and (B), examples of driving signals for driving the liquid crystal panel 10 are described. FIGS. 5(A) and (B) are a waveform chart of a driving signal (scanning signal) applied to the Y electrodes Y1, Y2, Y3, . . . and a waveform chart of a driving signal (image signal) applied to the X electrodes X1, X2, X3, . . . , respectively. In FIGS. 5(A) and (B), the waveforms corresponding to two frame periods are shown. According to these waveform charts, the Y electrodes Y1, Y2, Y3, . . . are sequentially selected every selection period.

In FIG. 5(A), in the first frame period, voltage V5 of the scanning signal is at a non-selecting voltage level, and voltage V1 is at a selecting voltage level. In this selection period, when voltage V6 is applied to the X electrodes X1, X2, X3, . . . , an ON voltage is applied to the liquid crystal layer 15. When voltage V4 is applied to the X electrodes X1, X2, X3, . . . , an OFF voltage is applied to the liquid crystal layer 15. In accordance with such variations in the voltage, the liquid crystal layer 15 controls the polarization of the incident light, thus displaying an image on the liquid crystal panel 10. These potentials V1 to V6 are generated by the liquid crystal power supply circuit 40 shown in FIG. 1.

In the subsequent frame, the polarity of the voltage impressed on the liquid crystal layer 15 is reversed. Hence, the selecting voltage level of the scanning signal becomes V6, and the non-selective level becomes V2. When the image signal is at V1, the ON voltage is applied to the liquid crystal layer 15. When the image signal is at V3, the OFF voltage is applied.

(Structure for temperature compensation)

Figure 6:
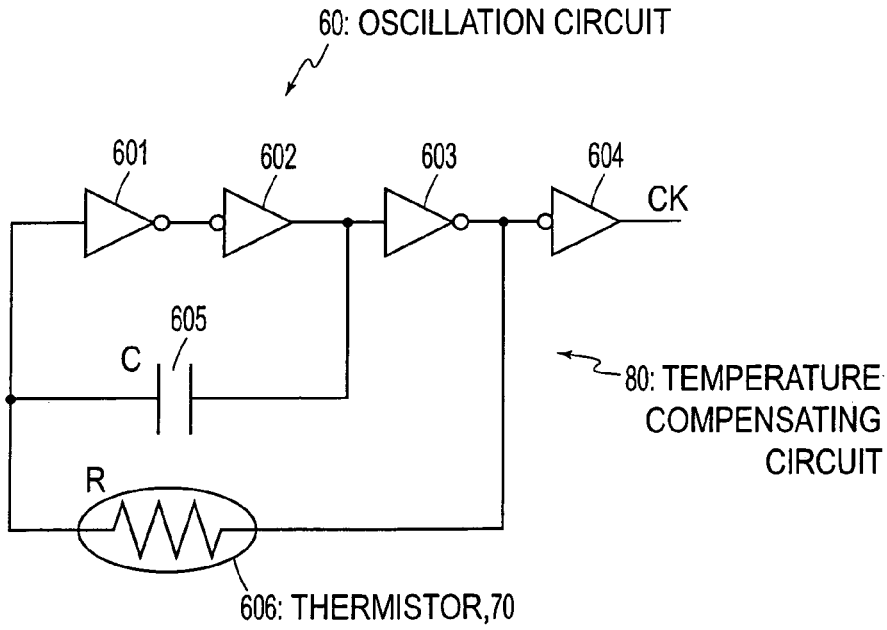
FIG. 6 is an equivalent circuit diagram of the circuit configuration for performing temperature compensation with respect to the driving signals output from driving circuits in the liquid crystal device according to the first exemplary embodiment of the present invention.
Figure 7:
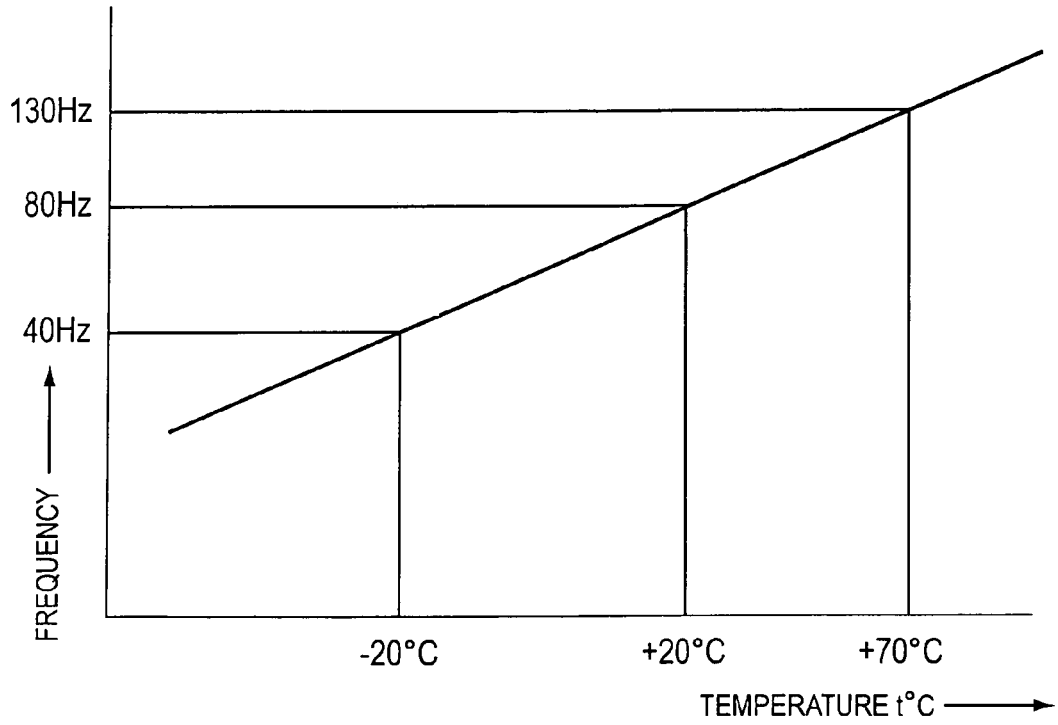
FIG. 7 is a graph showing the relationship between the frame frequency and the temperature of the liquid crystal device according to the first exemplary embodiment of the present invention.
Figure 8:
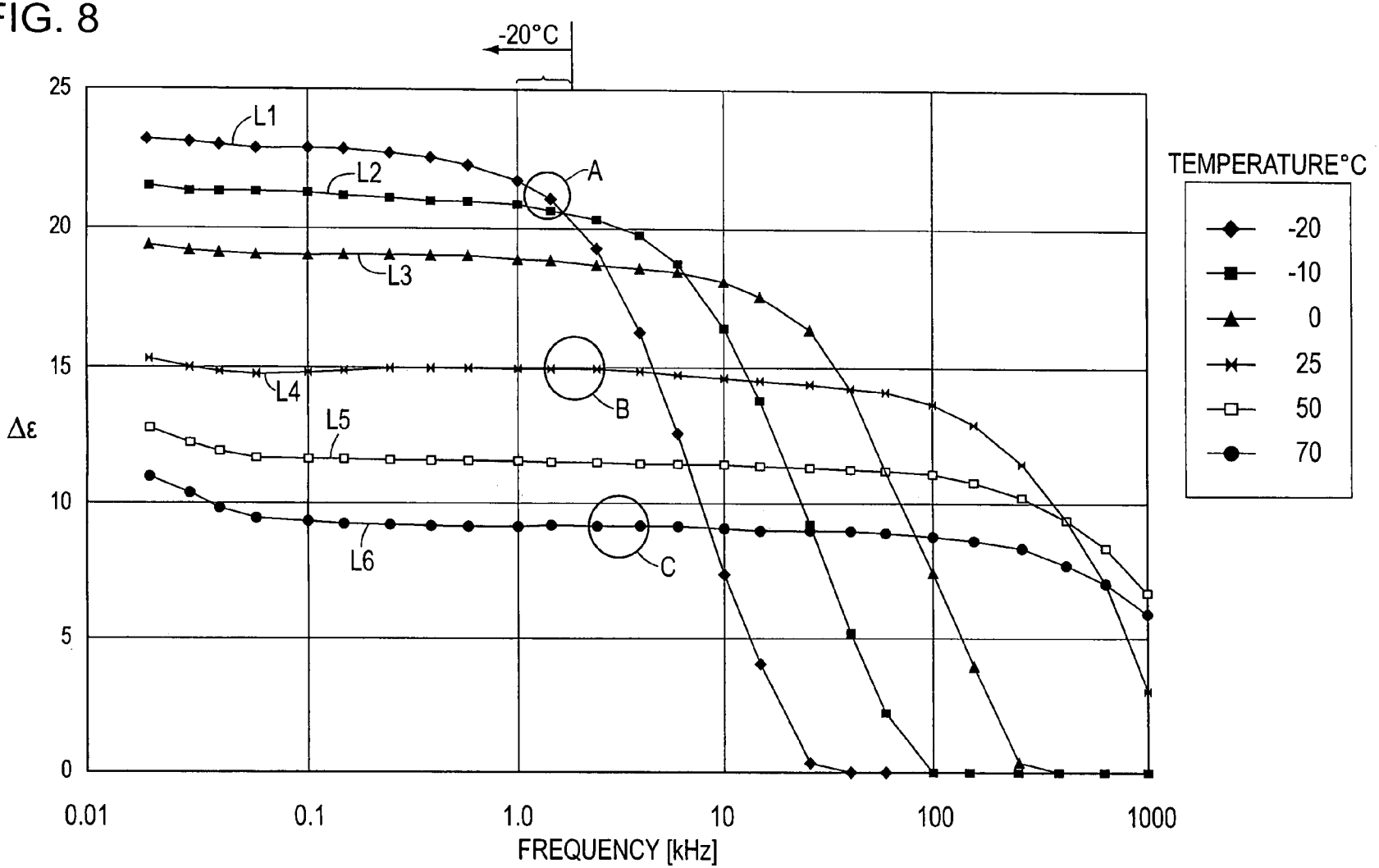
FIG. 8 is a graph showing the frequency characteristics of the dielectric anisotropy of the liquid crystal at each temperature.
Figure 9:
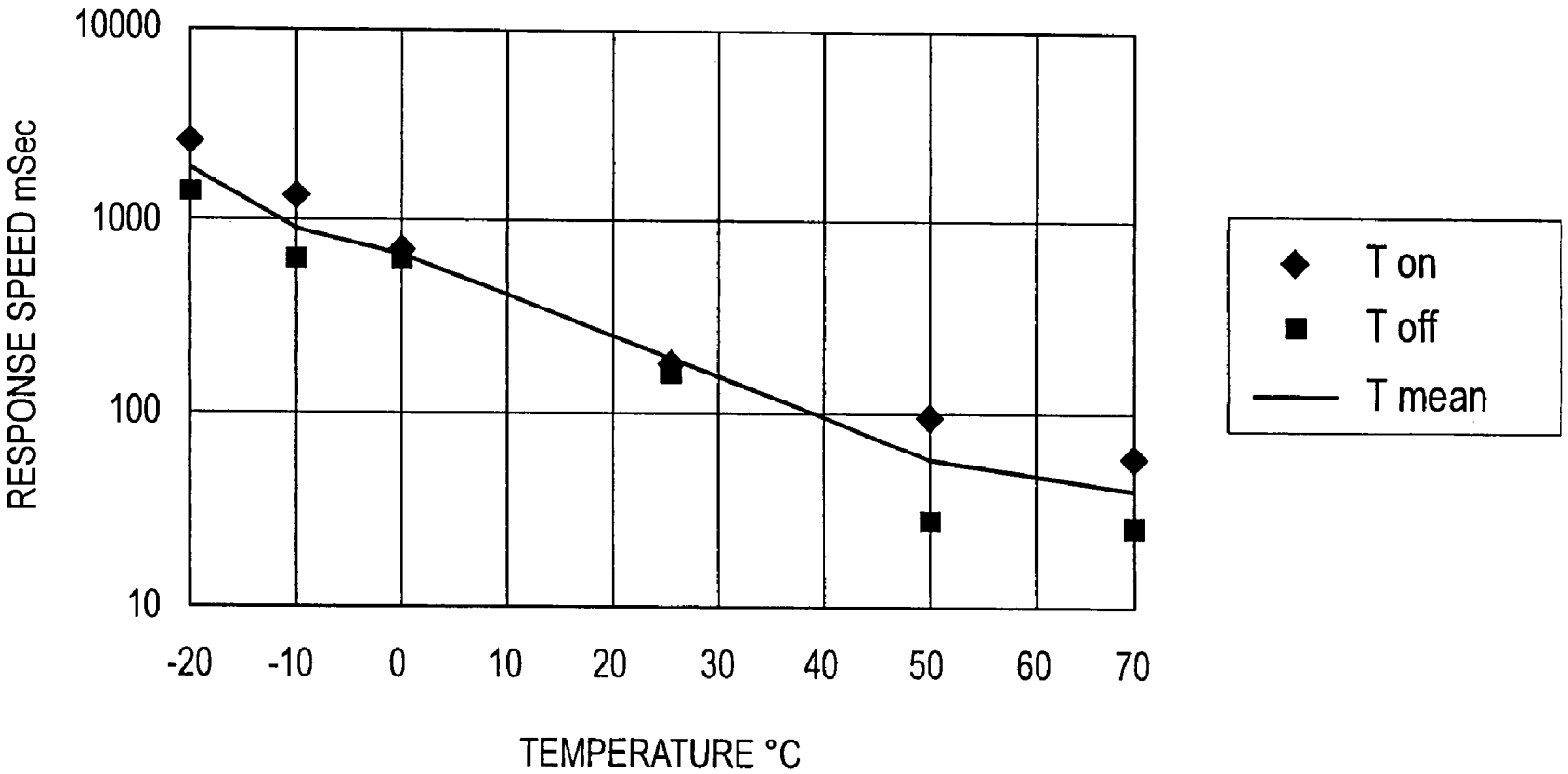
FIG. 9 is a graph showing the response speed of the liquid crystal at each temperature.
Figure 10A:
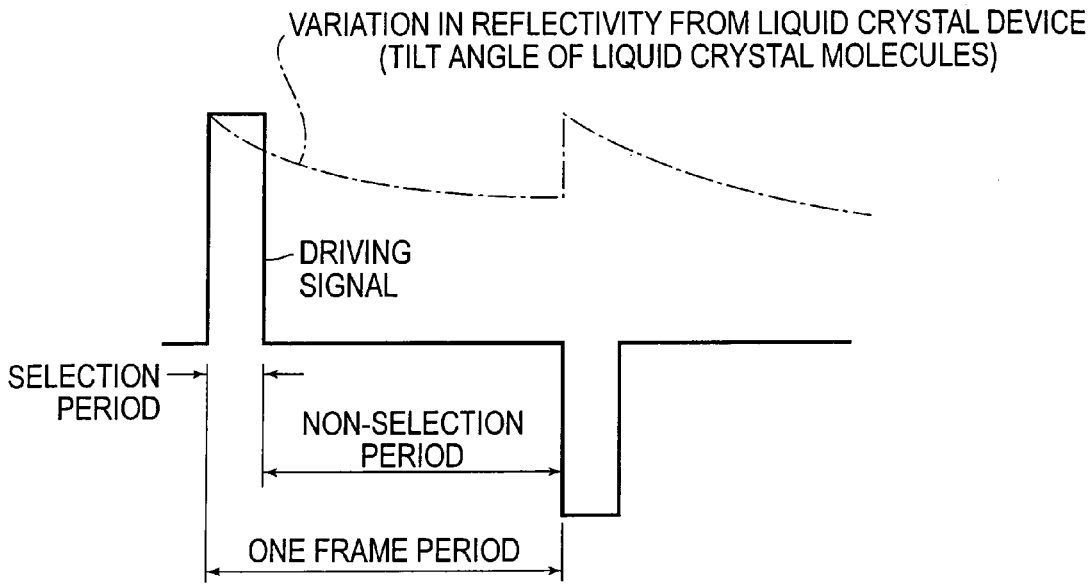
FIGS. 10(A) and (B) are illustrations of discharging from the liquid crystal panel and timing for writing image data when the liquid crystal is driven at a low temperature and a high temperature, respectively.

FIG. 6 is an equivalent circuit diagram of the structure of the oscillation circuit 60 and the temperature compensating circuit 80 provided in the liquid crystal device 1 of the embodiment. FIG. 7 is a graph showing the relationship between frame frequencies set by the temperature compensating circuit 80 and temperatures. FIG. 8 is a graph showing frequency characteristics of the dielectric anisotropy $\Delta\epsilon$ of the liquid crystal at each temperature. FIG. 9 is a graph showing the response speed of the liquid crystal at each temperature. FIGS. 10(A) and (B) are illustrations of the relationship between the motion of the liquid crystal molecules and the write cycle at a low temperature and a high temperature, respectively. Driving signals shown in FIGS. 10(A) and (B) are signals synthesized by combining the scanning signal and the image signal. These driving signals are illustrated such that there is no voltage fluctuation in the non-selection period.

According to the liquid crystal device 1 of the embodiment, as shown in FIG. 1, the oscillation circuit 60 for outputting the reference clock signal CK to the liquid crystal drive control circuit 50 is provided with the temperature compensating circuit 80. Based on the temperature detection results obtained by the temperature sensor 70, the temperature compensating circuit 80 changes the frequency of the reference clock signal output from the oscillation circuit 60, thus changing the frame frequencies of the driving signals output from the driving circuits 20 and 30 to a lower frequency when the temperature is low and to a higher frequency when the temperature is high.

Concerning the temperature sensor 70, a thermistor utilizing the fact that the resistance of a bulk semiconductor varies with temperature is used. In this embodiment, the thermistor is formed on the same semiconductor chip along with the driving circuits 20 and 30 or with the driving circuits 20 and 30, the liquid crystal drive control circuit 50, and the like.

Concerning the temperature compensating circuit 80, the circuit as shown in FIG. 6 is used in this embodiment. The temperature compensating circuit 80 and the oscillation circuit 60 are formed on the same semiconductor chip along with the driving circuits 20 and 30 and the like.

In FIG. 6, the oscillation circuit 60 for generating the reference clock is represented by a three-stage inverter circuit. Concerning the temperature compensating circuit 80 of the embodiment, one terminal of a capacitor 605 and one terminal of a thermistor 606 used as the temperature sensor 70 are connected to an input end of a first-stage inverter 601. The other terminal of the capacitor 605 is connected to an output end of a second-stage inverter 602 and to an input end of a third-stage inverter 603. The other terminal of the thermistor 606 is connected to an output end of the third-stage inverter 603 and an input end of a fourth-stage inverter 604.

Concerning the oscillation circuit 60 having such a three-stage inverter, the oscillation frequency f is determined by the following expression (2):

$$\text{oscillation frequency } f \approx (2.2/CR) \quad (2)$$

Symbol C is the capacitance of the capacitor 605, and symbol R is the resistance of the thermistor (temperature sensor 70). Concerning the thermistor, a thermistor tradenamed "NTH5D series" by Murata Manufacturing Co., Ltd. is used, and the resistance of this thermistor decreases as the temperature increases. As a result, from expression (2), the frequency of the reference clock signal CK increases. In contrast, concerning the thermistor, the resistance increases as the temperature decreases. As a result, from expression (2), the frequency of the reference clock signal CK decreases. Therefore, the frequency of the driving signals output from the driving circuits 20 and 30 varies in accordance with the temperature, as shown in FIG. 7. For example, the temperature compensating circuit 80 sets the frame frequency to not greater than 40 Hz when the temperature is −20° C. When the temperature is +25° C., the frame frequency is set in the range of 70 Hz to 90 Hz. When the temperature is +70° C., the frame frequency is set to 130 Hz or more.

Based on the frequency characteristics of the dielectric anisotropy $\Delta\epsilon$ of the liquid crystal shown in FIG. 8, the frequency of the driving signal is varied depending on the temperature. Hence, the level of the dielectric anisotropy $\Delta\epsilon$ is stabilized, and a threshold voltage Vth of the liquid crystal panel 10 is maintained substantially constant. For example, when 32 X electrodes are driven, the frame frequency is 40 Hz or less at −20° C. The image signal repetitively applies the ON voltage and the OFF voltage every horizontal scanning interval (1 H). When the voltage impressed on the pixels varies every H, the liquid crystals of the pixels are driven at a frequency of 32×40 Hz=1.28 kHz. In the actual display, there are cases in which the ON voltage or the OFF voltage is continuously applied to adjacent pixels. In these cases, the voltage of the image signal does not vary every H. In fact, the liquid crystals of the pixels are driven by the driving signal whose voltage varies under a condition that a frequency is not greater than 1.28 kHz (in FIG. 8, at a frequency lower than the condition indicated by symbol A). Concerning such a frequency band, the refractive index anisotropy $\Delta\epsilon$ of the liquid crystals is substantially a flat region with respect to variations in the frequency. When the temperature is +20° C., the frame frequency is, for example, 80 Hz. As in the above case, the liquid crystals of the pixels are driven by the driving signal whose voltage varies under a condition (indicated by symbol B in FIG. 8) that a frequency is not greater than 2.56 kHz (=32×80 Hz). In such a frequency band, the refractive index anisotropy $\Delta\epsilon$ of the liquid crystals is substantially a flat region with respect to variations in the frequency. When the temperature is +70° C. or more, the frame frequency is, for example, 130 Hz or more. As in the above case, the liquid crystals of the pixels are driven by the driving signal whose voltage varies under a condition (at a frequency higher than the condition indicated by symbol C) that a frequency is not greater than 4.16 kHz (=32×130 Hz). In such a frequency band, the refractive index anisotropy $\Delta\epsilon$ of the liquid crystals is substantially a flat region with respect to variations in the frequency. Therefore, under all temperature conditions, the liquid crystals are driven in a region in which the dielectric anisotropy $\Delta\epsilon$ of the liquid crystals is substantially flat with respect to the frequency. Hence, the threshold voltage Vth does not greatly vary. In the above description, it is assumed that the number of X electrodes is 32. The above conditions hold true for a liquid crystal panel having less than 32 X electrodes.

The Inventors examined the problem of generation of flicker or the like due to a decrease in the frequency of the driving signal, and obtained the results shown in FIG. 9.

FIG. 9 is a graph showing the dependency of the response speed on the temperature of the liquid crystal.

As shown in FIG. 9, the response speed of the liquid crystal decreases as the temperature decreases. For example, it takes 1000 msec, that is, approximately one second, to respond at −20° C. This is because the viscosity of the liquid crystal increases as the temperature decreases. According to the embodiment, when the frequency of the driving signal is set to be low at a low temperature in accordance with the frequency characteristics of the liquid crystal, the motion of the liquid crystal molecules is slow, as shown in FIG. 10(A). The liquid crystal molecular orientation is maintained until the subsequent write cycle begins. Therefore, flicker or the like does not occur.

Figure 10B:
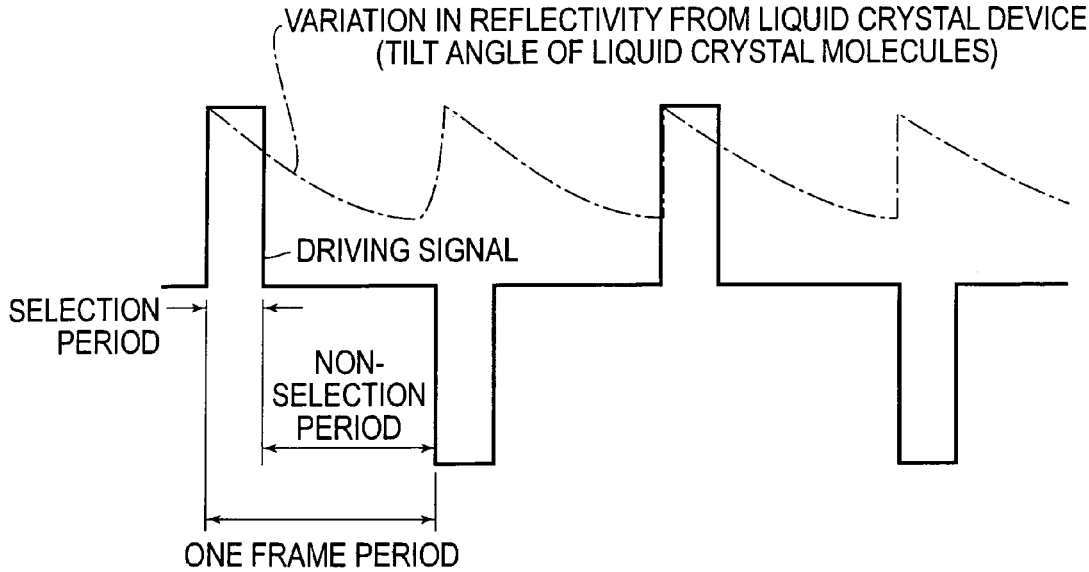

As shown in FIG. 10(B), the motion of the liquid crystal molecules is fast at a high temperature. According to the embodiment, the frame frequency is set to be high at a high temperature. When the speed of the motion of the liquid crystal molecules increases, the time until the subsequent writing is performed is short. Hence, flicker or the like does not occur, and brightness variation is reduced.

As described above, according to this exemplary embodiment, the frame frequency is set to a lower frequency at a low temperature based on the temperature detection results obtained by the temperature sensor 70. Due to the frequency characteristics of the liquid crystals, the liquid crystals can be driven in a region in which the dielectric anisotropy $\Delta\epsilon$ is substantially flat. When a device is used over a wide range of temperatures, such as in a cellular phone, the threshold voltage Vth is maintained substantially constant by performing temperature compensation. Therefore, it is possible to display a high-quality image. When the temperature is low, the motion of the liquid crystal molecules is slow. The display quality is not degraded even when the frame frequency is set to a lower frequency.

When the temperature is high, the motion of the liquid crystals becomes active. Hence, the liquid crystal molecular orientation cannot be maintained. According to the embodiment, the frame frequency is set to a high frequency when the temperature is high. At a high temperature, flicker does not occur and the brightness does not vary. It is thus possible to perform high-quality display.

The thermistor as the temperature sensor 70 can be externally provided. In this exemplary embodiment, the thermistor utilizes variations in the resistance of the bulk semiconductor (silicon substrate). The capacitor is also formed on the silicon substrate. According to this exemplary embodiment, the oscillation circuit 60, the temperature sensor 70, and the temperature compensating circuit 80 are formed on the same silicon substrate of a semiconductor device including the driving circuits 20 and 30, the liquid crystal drive control circuit 50, and the like. Therefore, these circuits can be formed into one chip.

Exemplary Embodiment 2

Figure 11:
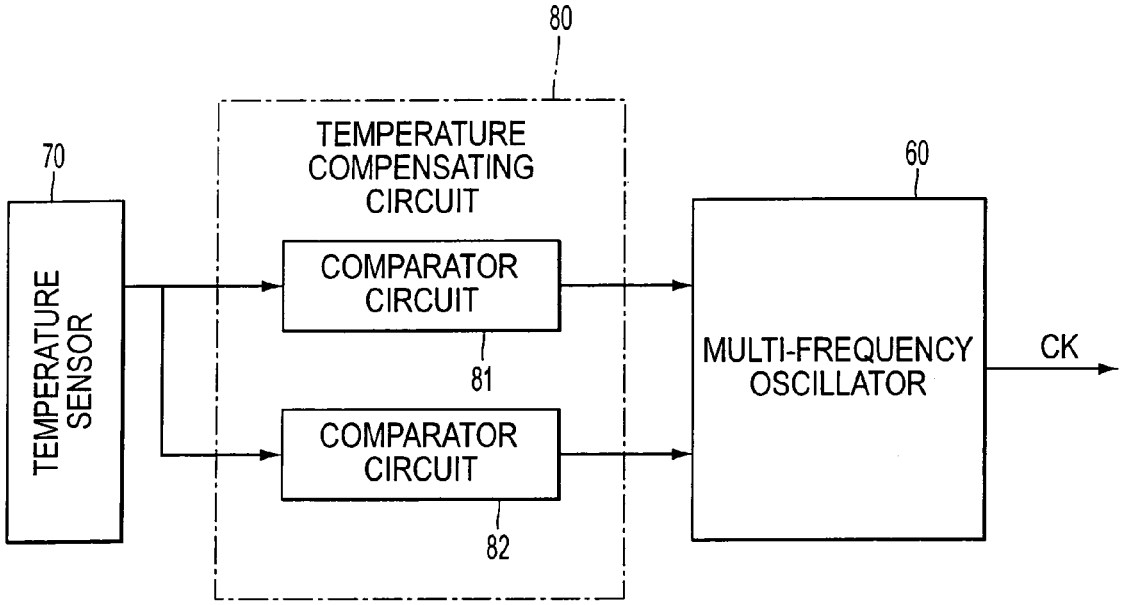
FIG. 11 is an equivalent circuit diagram of the circuit configuration for performing temperature compensation with respect to driving signals output from driving circuits in a liquid crystal device according to a second exemplary embodiment of the present invention.

FIG. 11 is a block diagram of the structure of a temperature-compensated oscillator for outputting a reference clock signal to a liquid crystal drive control circuit 50 included in the structure of a liquid crystal device of another exemplary embodiment. According to this exemplary embodiment and the following exemplary embodiments, the basic structures of a liquid crystal device 1 and a liquid crystal panel 10 are the same as those described in the first exemplary embodiment with reference to FIGS. 1 to 5. The same reference numerals are given to corresponding components, and repeated descriptions of the common portions are omitted. The characteristics of the liquid crystals used for the liquid crystal device are the same as those described with reference to FIGS. 8 to 10B, and descriptions thereof are omitted.

According to the embodiment, as shown in FIG. 11, a low frequency signal is used as a driving signal at a low temperature and a high frequency signal is used at a high temperature based on the detection results obtained by a temperature sensor 70. To this end, a temperature compensating circuit 80 provided with two comparator circuits (a first comparator circuit 81 and a second comparator circuit 82) is formed. Concerning an oscillator 60, a multi-frequency oscillator for outputting a reference clock signal CK in accordance with the output results from the temperature compensating circuit 80 is used.

According to this exemplary embodiment, the temperature compensating circuit 80 outputs signals in accordance with the following combinations and controls the multi-frequency oscillator (oscillator 60):

Condition A: the first comparator circuit 81 is turned off, and the second comparator circuit 82 is tuned off Condition B: the first comparator circuit 81 is turned on, and the second comparator circuit 82 is turned off Condition C: the first comparator circuit 81 is turned on, and the second comparator circuit 82 is turned on For example, the first comparator circuit 81 is turned on and off at approximately −10° C. The second comparator circuit 82 is turned on and off at approximately +50° C.

Both the first comparator circuit 81 and the second comparator circuit 82 have hysterisis characteristics. These hysterisis characteristics can be easily achieved by adopting a known structure, such as by applying positive feedback to operational amplifiers used for the first comparator circuit 81 and the second comparator circuit 82.

According to the liquid crystal device 1 having the above structure, when the temperature detection results obtained by the temperature sensor 70 are input to the temperature compensating circuit 80 including the two comparator circuits 81 and 82, the temperature compensating circuit 80 outputs a signal corresponding to any one of the conditions A, B, and C to the multi-frequency oscillator (oscillator 60). As a result, under the condition A, the multi-frequency oscillator outputs the reference clock signal CK in which the frame frequency is 40 Hz or less. Under the condition B, the multi-frequency oscillator outputs the reference clock signal CK in which the frame frequency is 80 Hz or less. Under the condition C, the multi-frequency oscillator outputs the reference clock signal CK in which the frame frequency is 130 Hz or more.

Figure 12:
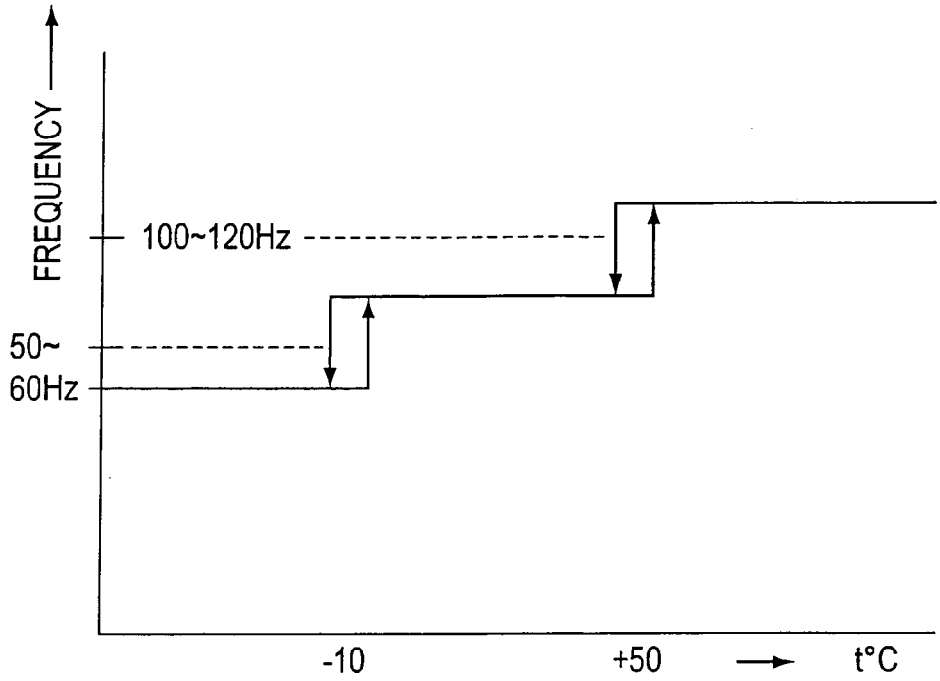
FIG. 12 is a graph showing the relationship between the frame frequency and the temperature of the liquid crystal device according to the second exemplary embodiment of the present invention.

As a result, according to the liquid crystal device of the embodiment, the relationship between the frame frequency and the temperature is such that the frame frequency increases in a stepwise manner from a low temperature to a high temperature, as shown in FIG. 12. Since the frame frequency varies in a stepwise manner, the frame frequency varies while avoiding 50 Hz (or 60 Hz), that is, the commercial frequency, and 100 Hz (or 120 Hz) corresponding to an integer multiple of that frequency.

According to this exemplary embodiment, the frame frequency varies in a stepwise manner based on the temperature detection results obtained by the temperature sensor 70. At any temperature, the liquid crystals can be driven in a region in which the dielectric anisotropy $\Delta\epsilon$ is substantially flat due to the frequency characteristics of the liquid crystals. When the temperature decreases within the operating temperature range, the threshold voltage Vth is substantially constant. When the temperature increases, the liquid crystal panel 10 is driven with a timing corresponding to the motion of the liquid crystal molecules. Hence, it is possible to perform high-quality display.

Because the first comparator circuit 81 and the second comparator circuit 82 have the hysterisis characteristics, it can be concluded from FIG. 12 that the frame frequency is smoothly switched in the vicinity of −10° C. and +50° C. at which the frequency is changed. Hence, a phenomenon such as hunting does not occur.

Though the frame frequency varies from a low frequency to a high frequency, it is configured that frequencies near 50 Hz and 60 Hz and frequencies corresponding to integer multiples of 50 Hz and 60 Hz are avoided. Thus, the frame frequency does not overlap the frequency of the commercial power supply (50 Hz or 60 Hz). It is thus possible to prevent flicker from occurring in an image under fluorescent light.

It is preferable that switching of the frame frequency satisfy the same conditions as those in the first exemplary embodiment. Specifically, when the temperature is −20° C., the frame frequency is 40 Hz or less. When the number of X electrodes is 32 or less, the liquid crystals of the pixels are driven under a condition that a frequency is 1.28 kHz or less. When the temperature is +20° C., the frame frequency is, for example, 80 Hz, and the liquid crystals are driven under a condition that a frequency is 2.56 kHz or less. When the temperature is +70° C. or more, the frame frequency is, for example, 130 Hz or more, and the liquid crystals are driven under a condition that a frequency is 4.16 kHz or less. Concerning the refractive index anisotropy $\Delta\epsilon$ of the liquid crystals, a substantially flat region with respect to variations in the frequency can be used. Under all temperature conditions, the liquid crystals are driven in a region in which the dielectric anisotropy $\Delta\epsilon$ of the liquid crystals is substantially flat with respect to the frequency. Hence, the threshold voltage Vth does not greatly vary, which is preferable.

Exemplary Embodiment 3

Figure 13:
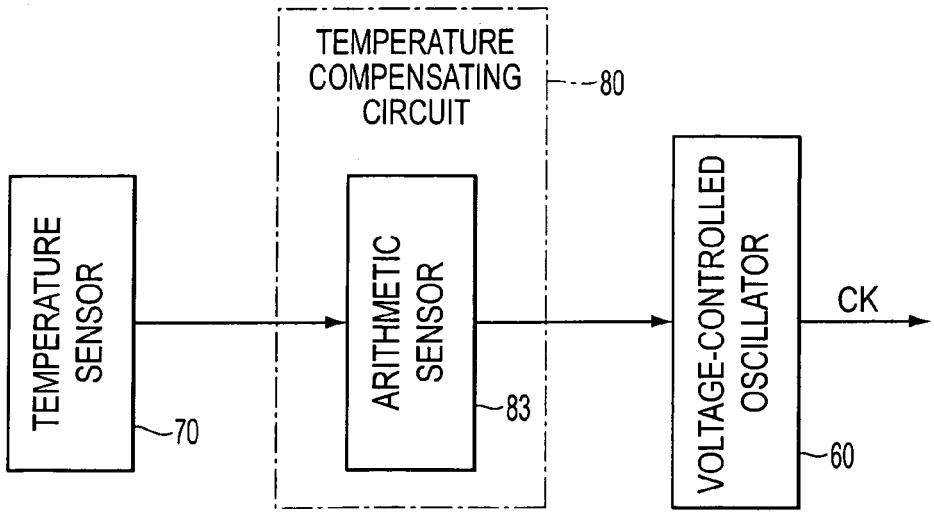
FIG. 13 is an equivalent circuit diagram of the circuit configuration for performing temperature compensation with respect to driving signals output from driving circuits in a liquid crystal device according to a third exemplary embodiment of the present invention.

FIG. 13 is a block diagram of the structure of a temperature-compensated oscillator for outputting a reference clock signal to a liquid crystal drive control circuit 50 included in the structure of a liquid crystal device of another exemplary embodiment.

According to this exemplary embodiment, as shown in FIG. 13, based on the detection results obtained by a temperature sensor 70, a low frequency signal is used as a driving signal at a low temperature and a high frequency signal is used at a high temperature. To this end, a temperature compensating circuit 80 using an arithmetic circuit 83 is formed. According to the embodiment, a voltage-controlled oscillator is used as an oscillator 60.

Figure 14:
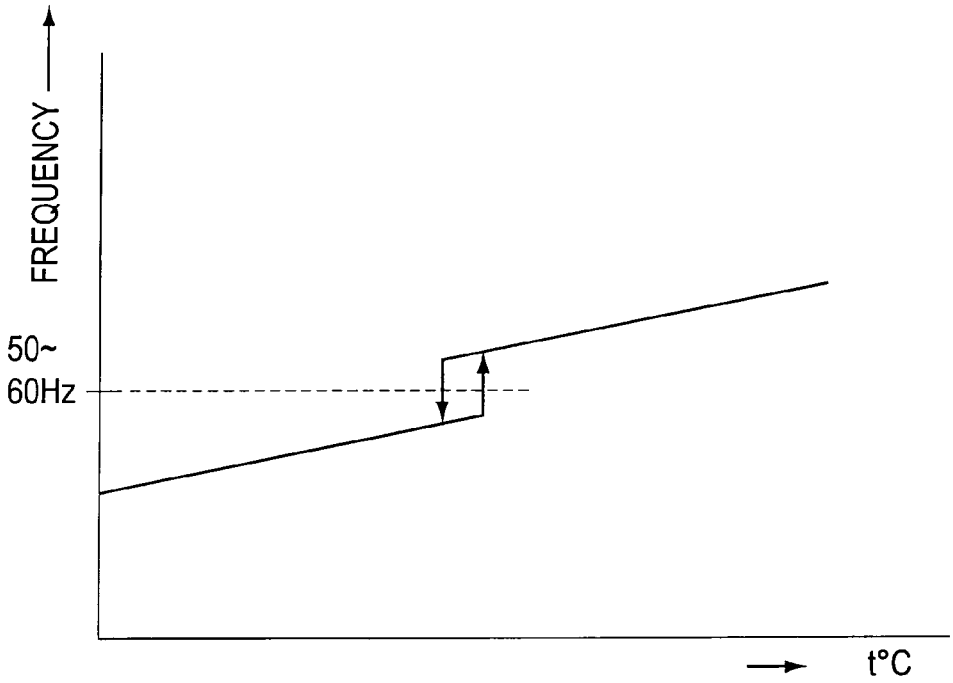
FIG. 14 is a graph showing the relationship between the frame frequency and the temperature of the liquid crystal device according to the third exemplary embodiment of the present invention.

Since the temperature compensating circuit 80 is provided with the arithmetic circuit 83 for performing predetermined arithmetic processing, a reference clock signal CK is output from the voltage-controlled oscillator (oscillator 60) to the liquid crystal drive control circuit 50 so as to drive liquid crystals under a condition as illustrated in FIG. 14.

Specifically, the arithmetic circuit 83 performs a predetermined operation based on the detection results obtained by the temperature sensor 70. When a voltage in accordance with the operation result is output to the voltage-controlled oscillator (oscillator 60), the voltage-controlled oscillator (oscillator 60) outputs the reference clock signal CK at a frequency in accordance with the voltage to the liquid crystal drive control circuit 50. Δϵ a result, concerning driving signals output from driving circuits 20 and 30, the frame frequency continuously increases from a low frequency to a high frequency as the temperature varies from a low temperature to a high temperature. According to this exemplary embodiment, when the temperature is −20° C., the frame frequency is switched at 40 Hz or less. When the temperature is +25° C., the frame frequency is switched at a frequency in the range of 70 Hz to 90 Hz. When the temperature is +70° C., the frame frequency is switched at 130 Hz or more. Therefore, when the number of X electrodes is 32 or less, and when the temperature is −20° C., the liquid crystals of pixels are driven at 1.28 kHz or less. When the temperature is +20° C., the liquid crystals are driven at 2.56 kHz or less. When the temperature is +70° C. or greater, the liquid crystals are driven at 4.16 kHz or less. Concerning the refractive index anisotropy Δϵ of the liquid crystal, a substantially flat region with respect to variations in the frequency can be used. Because the frame frequency suddenly changes at a temperature at which the frame frequency becomes 50 Hz, frequencies near 50 Hz can be avoided. In addition, the arithmetic circuit 83 is formed so that such a sudden change occurs in a hysteretic manner.

According to this exemplary embodiment, the frame frequency continuously varies while avoiding specific frequencies based on the temperature detection results obtained by the temperature sensor 70. At any temperature, the liquid crystals can be driven in a region in which the dielectric anisotropy Δϵ is substantially flat due to the frequency characteristics of the liquid crystals. Therefore, when the temperature decreases within the operating temperature range, the threshold voltage Vth is substantially constant. When the temperature increases, a liquid crystal panel 10 is driven with a timing in accordance with the motion of the liquid crystal molecules. It is thus possible to perform high-quality display.

Since the result of the operation performed by the arithmetic circuit 83 is configured to have a hysterisis, the frame frequency does not show a phenomenon such as hunting or the like when the frequency is switched.

Though the frame frequency varies from a low frequency to a high frequency, it is configured that frequencies near 50 Hz and 60 Hz are avoided. Thus, the frame frequency does not overlap the frequency of the commercial power supply (50 Hz or 60 Hz). It is thus possible to prevent flicker from occurring in an image.

Exemplary Embodiment 4

Figure 15:
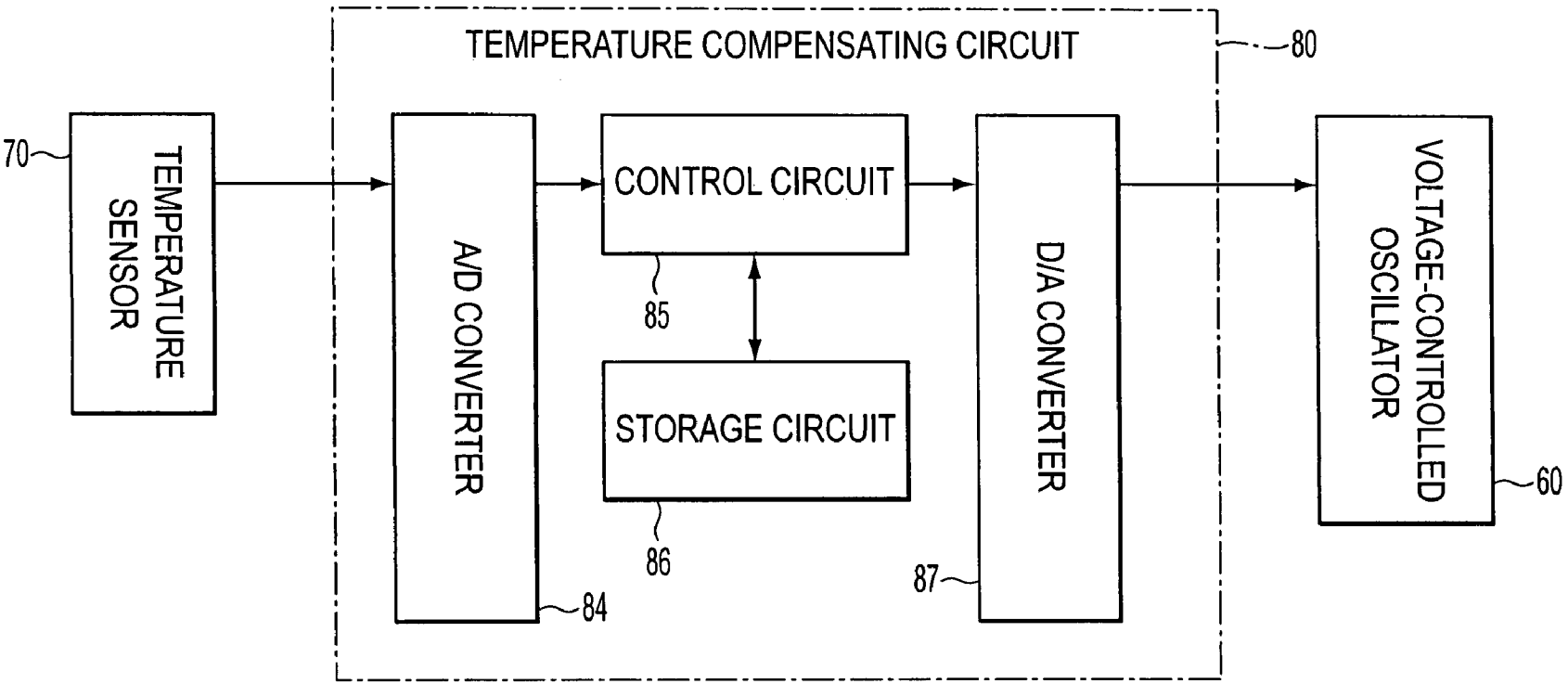
FIG. 15 is an equivalent circuit diagram of the circuit configuration for performing temperature compensation with respect to driving signals output from driving circuits in a liquid crystal device according to a fourth exemplary embodiment of the present invention.

FIG. 15 is a block diagram of the structure of a temperature-compensated oscillator for outputting a reference clock signal to a liquid crystal drive control circuit 50 included in the structure of a liquid crystal device of another exemplary embodiment.

According to this exemplary embodiment, as shown in FIG. 15, based on the detection results obtained by a temperature sensor 70, a low frequency signal is used as a driving signal at a low temperature and a high frequency signal is used at a high temperature. To this end, a temperature compensating circuit 80 including an A/D converter 84, a control circuit 85, a storage circuit 86, and a D/A converter 87 is formed. A voltage-controlled oscillator is used as an oscillator 60.

According to the temperature compensating circuit 80, the relationship between preset frame frequencies and temperatures is stored in the storage circuit 86. Specifically, data for generating a reference clock signal CK required to produce a predetermined frame frequency in accordance with variations in the temperature is stored in the storage circuit 86. For example, data for switching the frame frequency to 40 Hz or less when the temperature is −20° C., data for switching the frame frequency in the range of 70 Hz to 90 Hz when the temperature is +25° C., and data for switching the frame frequency to 130 Hz or more when the temperature is +70° C. are stored in the storage circuit 86.

According to a liquid crystal device 1 with the above arrangement, when the temperature detection result obtained by the temperature sensor 70 is input to the control circuit 85 through the A/D converter 84, the control circuit 85 reads data corresponding to that temperature from the storage circuit 86 and outputs the read result to the voltage-controlled oscillator (oscillator 60) through the D/A converter 87. Δϵ a result, the voltage-controlled oscillator (oscillator 60) outputs the reference clock signal CK in accordance with the temperature to the liquid crystal drive control circuit 50. A liquid crystal panel 10 is driven at the frame frequency in accordance with the temperature.

Figure 16:
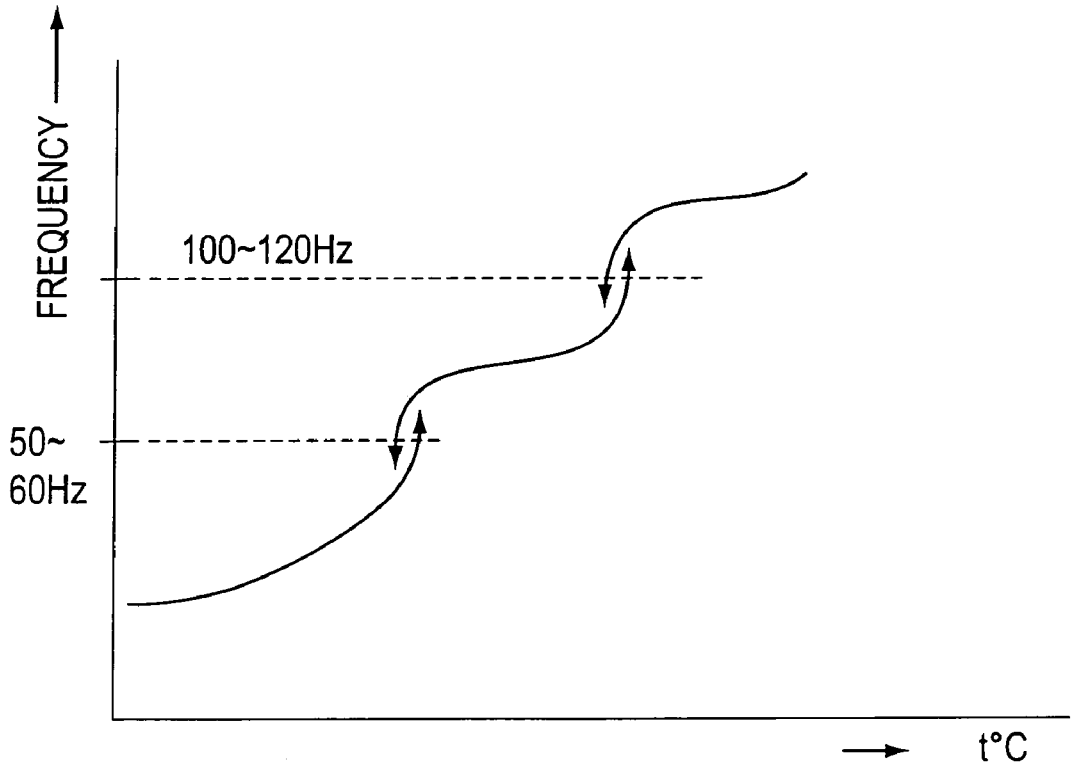
FIG. 16 is a graph showing the relationship between the frame frequency and the temperature of the liquid crystal device according to the fourth exemplary embodiment of the present invention.

Specifically, as shown in FIG. 16, concerning driving signals output from driving circuits 20 and 30, the frame frequency continuously increases from a low frequency to a high frequency as the temperature varies from a low temperature to a high temperature. According to this exemplary embodiment, the frame frequency is switched at 40 Hz or less when the temperature is −20° C. When the temperature is +25° C., the frame frequency is switched at a frequency in the range of 70 Hz to 90 Hz. When the temperature is +70° C., the frame frequency is switched at 130 Hz or more. Therefore, when the number of X electrodes is 32 or less, and when the temperature is −20° C., the liquid crystals of pixels are driven at 1.28 kHz or less. When the temperature is +20° C., the liquid crystals are driven at 2.56 kHz or less. When the temperature is +70° C. or greater, the liquid crystals are driven at 4.16 kHz or less. Concerning the refractive index anisotropy Δϵ of the liquid crystal, a substantially flat region with respect to variations in the frequency can be used. The frame frequency is suddenly switched at temperatures at which the frame frequency becomes 50 Hz (or 60 Hz) and 100 Hz (or 120 Hz) which is twice that frequency. Hence, the frame frequency does not become 50 Hz (60 Hz) nor 100 Hz (120 Hz) which is an integer multiple of that frequency. In addition, data for causing such a sudden change to occur in a hysteretic manner is stored in the storage circuit 86.

According to this exemplary embodiment, the frame frequency continuously varies based on the temperature detection results obtained by the temperature sensor 70 while avoiding specific frequencies. At any temperature, the liquid crystals can be driven in a region in which the dielectric anisotropy $\Delta\epsilon$ is substantially flat due to the frequency characteristics of the liquid crystals. Therefore, the threshold voltage is substantially constant even when the temperature decreases within the operating temperature range. When the temperature increases, a liquid crystal panel 10 is driven with a timing in accordance with the motion of the liquid crystal molecules. It is thus possible to perform high-quality display.

Since the result of the operation performed by the arithmetic circuit 83 is configured to have a hysterisis, the frame frequency does not show a phenomenon such as hunting or the like when the frequency is switched.

Though the frame frequency varies from a low frequency to a high frequency, it is configured that frequencies near 50 Hz and 60 Hz are avoided. Thus, the frame frequency does not overlap the frequency of the commercial power supply (50 Hz or 60 Hz). It is thus possible to prevent flicker from occurring in an image.

Other Exemplary Embodiments

While the STN panel is described in the above exemplary embodiments, the present invention is not limited to these embodiments. The present invention is applicable to various liquid crystal modes such as the TN mode.

In the above exemplary embodiments, cases in which the present invention is applied to the simple matrix liquid crystal device 1 are described. However, the present invention is not limited to these embodiments. The present invention is applicable to an active matrix liquid crystal device in which each pixel is provided with a TFT or a TFD used as a switching device.

In the description of the above exemplary embodiments, the driving waveforms are illustrated using multiplex driving, as shown in FIG. 5, in order to clearly describe features of the present invention. However, the present invention is not limited to these exemplary embodiments. The present invention can be applied to a liquid crystal device in which multi-line driving (MLS or MLA) for simultaneously selecting a predetermined number of X electrodes X1, X2, X3, . . . based on an orthogonal function and performing sequential selection every predetermined number of X electrodes.

The frequency (frequency at which the polarity is reversed) of a driving signal for driving the liquid crystal of each pixel is determined as follows. Concerning the frequency characteristics of the dielectric anisotropy of the liquid crystal at each temperature shown in FIG. 8, a region in which the refractive index anisotropy $\Delta\epsilon$ of the liquid crystal is substantially flat with respect to variations in the temperature is used. To this end, the frequency (frequency at which the polarity of voltage is reversed) of the driving signal is set to 1.28 kHz or less when the temperature is −20° C. The frequency is set to 2.56 kHz or less when the temperature is +20° C. The frequency is set to 4.16 kHz or less when the temperature is +70° C. or greater. Accordingly, the number of X electrodes and the frame frequency are not limited to those described in the above embodiments.

Specific Examples of Electronic Apparatuses

Figure 17A:
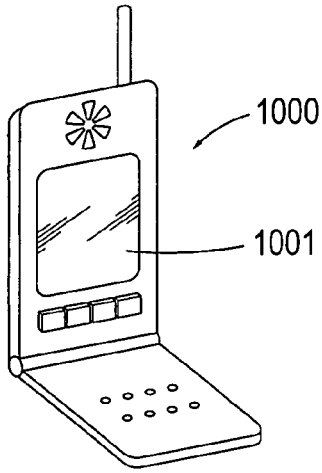
FIGS. 17(A), (B), and (C) are illustrations of electronic apparatuses each having a liquid crystal device to which the present invention is applied.

FIGS. 17(A), (B), and (C) each show an external view of an electronic apparatus using a liquid crystal device 1 to which the present invention is applied.

FIG. 17(A) is an external view of a cellular phone. In this drawing, numeral 1000 indicates a cellular phone main body and numeral 1001 indicates an image display device using the liquid crystal device 1 to which the present invention is applied.

Figure 17B:
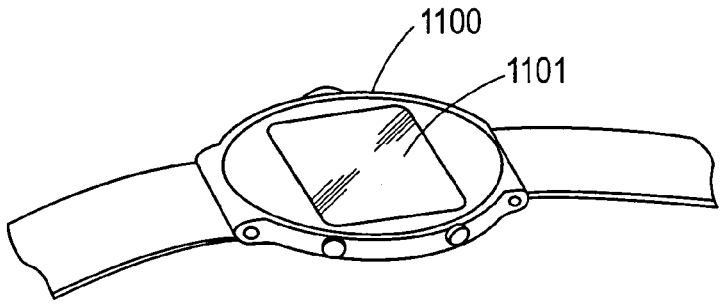

FIG. 17(B) is an external view of a wristwatch-type electronic apparatus. In this drawing, numeral 1100 indicates a watch main body and numeral 1101 indicates an image display device using the liquid crystal device 1 to which the present invention is applied.

Figure 17C:
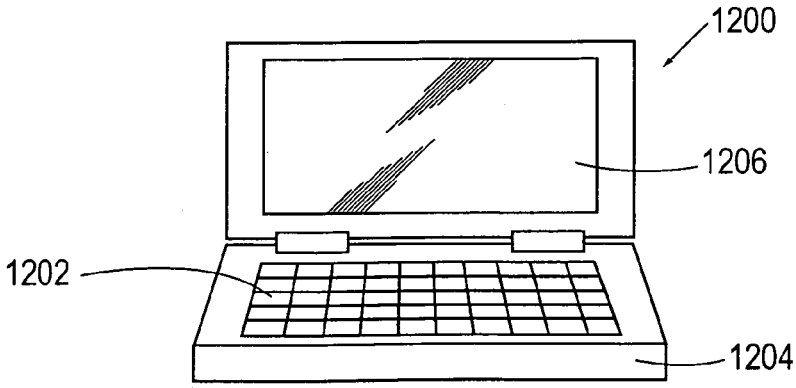
Figure 18:
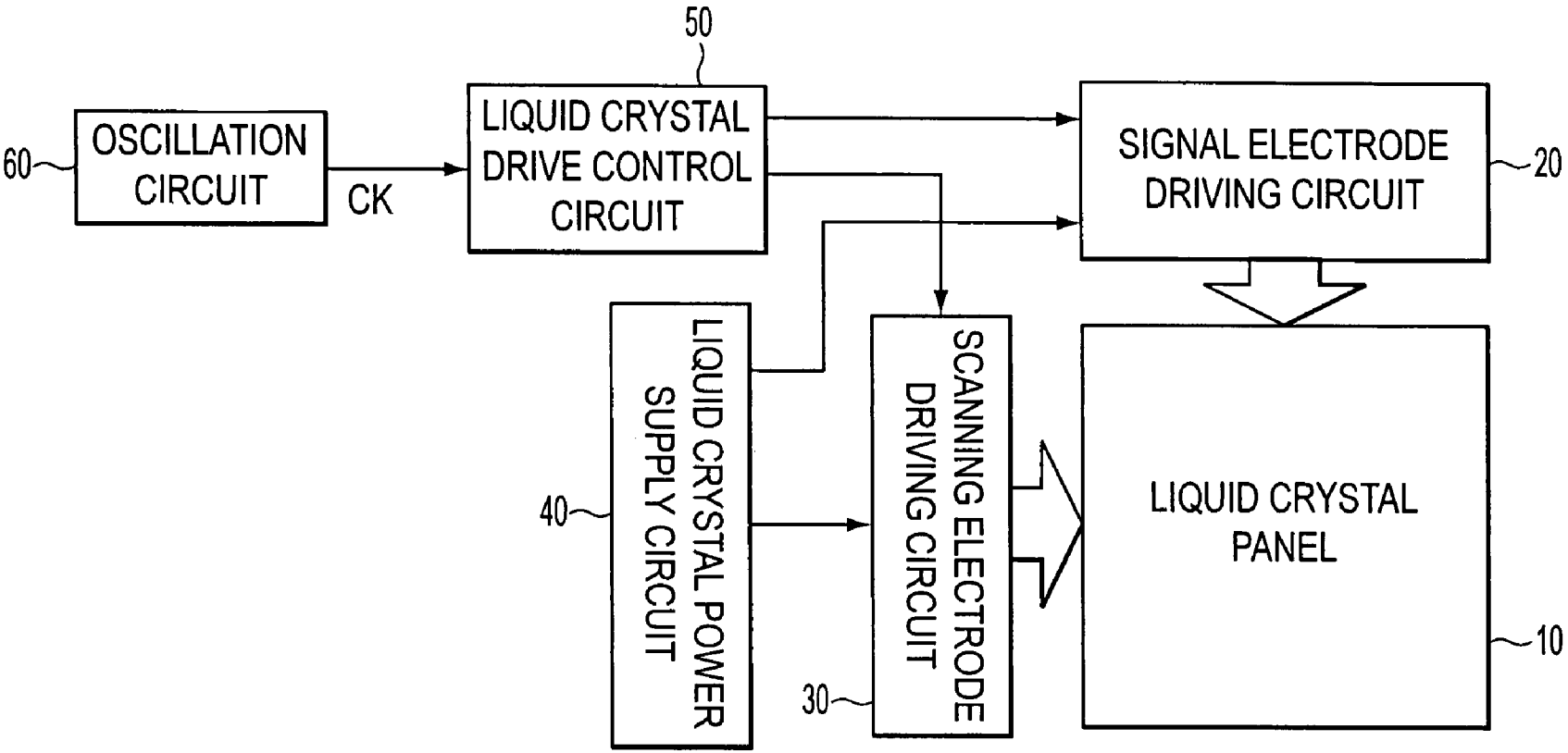
FIG. 18 is a block diagram of the schematic structure of a related liquid crystal device.

FIG. 17(C) is an external view of a portable information processing device, such as a word processor or a personal computer. In this drawing, numeral 1200 indicates the information processing device. Numeral 1202 indicates an input unit such as a keyboard. Numeral 1206 indicates an image display device using the liquid crystal device 1 to which the present invention is applied. Numeral 1204 indicates an information processing device main unit.

Since these electronic apparatuses each have the liquid crystal device 1 to which the present invention is applied as the display device, these electronic apparatuses can perform clear display at the operating temperatures ranging from a low temperature of approximately −25° C. to a high temperature of +70° C.

Advantages

As described above, according to the present invention, a low frequency signal is used as a driving signal at a low temperature so as to accommodate temperature dependent variations in the frequency characteristics of the dielectric anisotropy of a liquid crystal. Hence, the dielectric anisotropy $\Delta\epsilon$ is substantially flat with respect to the frequency. Therefore, the threshold voltage for driving a liquid crystal panel does not greatly vary within the operating temperature range, and high-quality display can be performed.

What is claimed is:

1. A liquid crystal panel driving method for a liquid crystal panel having a liquid crystal between a pair of electrodes in which optical characteristics of the liquid crystal are changed by applying a driving signal between the pair of electrodes, the liquid crystal panel driving method comprising:

sensing a temperature of at least one of the liquid crystal panel and an environment in which the liquid crystal panel is disposed; and applying a low frequency signal as the driving signal in case that the sensed temperature is low, the low frequency signal having a frequency lower than a frequency of a driving signal used in case that the sensed temperature is normal, and varying a frequency of the driving signal discontinuously with respect to the sensed temperature to exclude an integral multiple of a frequency of a commercial power supply.

2. The liquid crystal panel driving method according to claim 1, further comprising varying a frame frequency obtained when performing time-division driving a plurality of pixels arranged in a matrix form on the liquid crystal panel, based on the sensed temperature, so that at least a frequency corresponding to an integer multiple of 50 Hz is avoided.

3. The liquid crystal panel driving method according to claim 1, further comprising varying a frame frequency obtained when performing time-divisional driving of a plurality of pixels arranged in a matrix form on the liquid crystal panel, based on the sensed temperature, so that at least a frequency corresponding to an integer multiple of 60 Hz is avoided.

4. The liquid crystal panel driving method according to claim 1, further comprising setting a driving frequency of each pixel of the liquid crystal panel so that, when the temperature is −20° C., each pixel is driven at a frequency not greater than 1.28 kHz, and, when the temperature is +25° C., each pixel is driven at a frequency not greater than 2.56 kHz.

5. The liquid crystal panel driving method according to claim 4, further comprising setting the driving frequency of each pixel of the liquid crystal panel so that, when the temperature is +70° C., each pixel is driven at a frequency not greater than 4.16 kHz.

6. The liquid crystal panel driving method according to claim 4, each pixel being driven at a frequency not less than 0.256 kHz when the temperature is at +25° C. and at a frequency not less than 0.1 kHz when the temperature is at −20° C.

7. The liquid crystal panel driving method according to claim 1, further comprising setting a frame frequency to not greater than 40 Hz when the temperature is within a range including −20° C., and setting the frame frequency in the range of 70 Hz to 90 Hz when the temperature is within a range including +25° C.

8. The liquid crystal panel driving method according to claim 7, the frame frequency being set to not less than 130 Hz when the temperature is at +70° C.

9. The liquid crystal panel driving method according to claim 1, varying the frequency of the driving signal including continuously varying the signal at frequencies higher than, and lower than, the excluded predetermined frequency.

10. The method according to claim 1, wherein the frequency of the commercial power supply is 50 Hz.

11. The method according to claim 1, wherein the frequency of the commercial power supply is 60 Hz.

12. A liquid crystal device comprising a liquid crystal panel having a liquid crystal between a pair of substrates and a driving circuit that applies a driving signal between the pair of substrates and that varies optical characteristics of the liquid crystal, the liquid crystal device further comprising:

a temperature sensor that senses a temperature of at least one of the liquid crystal panel and an environment in which the liquid crystal panel is disposed; and a temperature compensating device that applies a low frequency signal as the driving signal in case that the sensed temperature is low, the low frequency signal having a frequency lower than a frequency of a driving signal used in case that the sensed temperature is normal, the temperature compensating device discontinuously varying a frequency of the driving signal with respect to the sensed temperature to exclude an integral multiple of a frequency of a commercial power supply.

13. The liquid crystal device according to claim 12, wherein the temperature compensating device varies a frame frequency obtained when performing time-division driving of a plurality of pixels arranged in a matrix form on the liquid crystal panel, based on the sensed temperature, so that at least a frequency corresponding to an integer multiple of 50 Hz is avoided.

14. The liquid crystal device according to claim 12, wherein the temperature compensating device varies a frame frequency obtained when performing time-division driving of a plurality of pixels arranged in a matrix form on the liquid crystal panel, based on the sensed temperature, so that at least a frequency corresponding to an integer multiple of 60 Hz is avoided.

15. The liquid crystal device according to claim 14, when varying the frame frequency while avoiding a specific frequency, the temperature compensating device varies the frame frequency in a hysteretic manner.

16. The liquid crystal device according to claim 15, the temperature compensating device avoiding a specific frequency and varying the frame frequency in accordance with the sensed temperature by varying the frame frequency in a stepwise manner.

17. The liquid crystal device according to claim 16, the temperature compensating device continuously varying the frame frequency in accordance with the sensed temperature except when the frame frequency is varied while avoiding a specific frequency.

18. The liquid crystal device according to claim 12, wherein the temperature compensating device sets a driving frequency of each pixel of the liquid crystal panel to not greater than 1.28 kHz when the temperature is −20° C. and to not greater than 2.56 kHz when the temperature is +25° C.

19. The liquid crystal device according to claim 18, the temperature compensating device setting the driving frequency of each pixel of the liquid crystal panel to not greater than 4.16 kHz when the temperature is +70° C.

20. The liquid crystal device according to claim 18, wherein the temperature compensating device is a synchronizing signal frequency varying device that varies a frequency of the driving signal by varying a frequency of a synchronizing signal applied to a liquid crystal drive control circuit for controlling the driving circuit based on the sensed temperature.

21. The liquid crystal device according to claim 18, the temperature sensor being a thermistor formed together with the driving circuit in a semiconductor device.

22. An electronic apparatus comprising the liquid crystal device as set forth in claim 21 as a display device.

23. The liquid crystal device according to claim 12, wherein the temperature compensating device sets the frame frequency to not greater than 40 Hz when the temperature is −20° C., sets the frame frequency in the range of 70 Hz to 90 Hz when the temperature is +25° C., and sets the frame frequency to not less than 130 Hz when the temperature is +70° C.

24. The liquid crystal device according to claim 12, wherein varying the frequency of the driving signal includes continuously varying the signal at frequencies higher than, and lower than, the excluded predetermined frequency.

25. The liquid crystal device according to claim 12, wherein the frequency of the commercial power supply is 50 Hz.

26. The liquid crystal device according to claim 12, wherein the frequency of the commercial power supply is 60 Hz.

* * * * *